US005150301A

United States Patent [19]

Kashiwabara et al.

[11] Patent Number: 5,150,301

[45] Date of Patent: Sep. 22, 1992

[54] AIR/FUEL MIXTURE RATIO LEARNING CONTROL SYSTEM FOR INTERNAL COMBUSTION ENGINE USING MIXED FUEL

[75] Inventors: Masuo Kashiwabara; Hideyuki Kojima; Hiromitsu Yamaura; Seiichi Otani, all of Gunma, Japan

[73] Assignee: Japan Electronic Control Systems Company Limited, Isezaki, Japan

[21] Appl. No.: 545,528

[22] Filed: Jun. 29, 1990

[30] Foreign Application Priority Data

Jun. 29, 1989 [JP] Japan ..... 1-165305

[51] Int. Cl.[5] ..... F02M 51/00

[52] U.S. Cl. ..... 364/431.05; 364/431.04; 123/1 A; 123/486; 123/494; 123/575

[58] Field of Search ..... 364/431.01, 431.03, 364/431.05, 431.04; 123/1 A, 478, 494, 575, 480, 486, 489

[56] References Cited

U.S. PATENT DOCUMENTS

| | | | |
|---|---|---|---|
| 4,546,732 | 10/1985 | Mae et al. | 123/1 A |
| 4,706,629 | 11/1987 | Wineland et al. | 123/478 |
| 4,909,225 | 3/1990 | Gonze et al. | 123/494 |
| 4,945,863 | 8/1990 | Schmitz et al. | 123/494 X |
| 4,945,880 | 8/1990 | Gonze et al. | 123/478 |
| 4,967,714 | 11/1990 | Inoue | 123/1 A |

OTHER PUBLICATIONS

Japanese Publication No. 59-203828, Appln. No. 58-76221, dated Nov. 19, 1984.

*Primary Examiner*—Parshotam S. Lall
*Assistant Examiner*—E. Pipala
*Attorney, Agent, or Firm*—Foley & Lardner

[57] ABSTRACT

An air/fuel mixture ratio learning control system for an internal combustion engine using a mixed fuel employs a learnt correction coefficient which is used both in a FEEDBACK mode air/fuel ratio control and in an OPEN LOOP mode air/fuel ratio control. The learnt correction coefficient is derived based on a FEEDBACK air/fuel ratio dependent correction coefficient per one of preselected engine driving ranges and per one of preselected concentration ranges of one fuel component contained in the mixed fuel. The learnt correction coefficient is cyclically derived in a preselected stable engine driving condition during the FEEDBACK mode air/fuel ratio control for updating a previously derived and stored one to minimize a deviation of the FEEDBACK correction coefficient from a reference value. The control system performs the FEEDBACK mode air/fuel ratio control with the FEEDBACK correction coefficient and the learnt correction coefficient, while the control system performs the OPEN LOOP mode air/fuel ratio control with the learnt correction coefficient.

13 Claims, 4 Drawing Sheets

AIR/FUEL MIXTURE RATIO LEARNING CONTROL SYSTEM FOR INTERNAL COMBUSTION ENGINE USING MIXED FUEL

BACKGROUND OF THE INVENTION

1. Field of the Invention

The present invention relates generally to an air/fuel mixture ratio learning control system for an internal combustion engine which uses a mixed fuel, such as, a gasoline-alcohol mixed fuel. The fuel may contain alcohol concentration of 0 to 100%. More specifically, the present invention relates to a learning control system for controlling an air/fuel ratio in a fuel injection internal combustion engine using a mixed fuel, wherein a fuel injection amount is precisely controlled at a desired value both in a FEEDBACK or CLOSED LOOP mode air/fuel ratio control and in an OPEN LOOP mode air/fuel ratio control, using a learnt correction coefficient which is set and updated per one of preselected engine driving ranges as well as per one of preselected alcohol concentrations contained in the mixed fuel.

2. Description of the Background Art

Learning control systems for controlling a mixture ratio of air and pure gasoline fuel have been proposed, such as disclosed in Japanese Patent First Publication No. 59-203828.

In this publication, a fuel injection amount $T_i$ is derived based on the following equation (1):

$$T_i = T_p \times C_{oef} \times K_{LAMBDA} \times K_{LRC} + T_s \quad (1)$$

where, $T_p$ is a basic fuel injection amount derived based on an engine speed and an engine load (an intake air flow rate, for example), $C_{oef}$ is a correction coefficient derived based on various engine operation parameters, such as an engine coolant temperature, $K_{LAMBDA}$ is a FEEDBACK air/fuel ratio dependent correction coefficient derived based on an oxygen concentration indicative signal from an oxygen sensor arranged in an exhaust system during the FEEDBACK mode control and composed of a proportional (P) component and an integral (I) component so as to perform the proportional-plus-integral control (PI control) of the fuel injection amount $T_i$, and $K_{LRC}$ is a learnt correction coefficient derived based on the FEEDBACK correction coefficient $K_{LAMBDA}$. The learnt correction coefficient $K_{LRC}$ is cyclically derived and updated with respect to each of mutually distinct various engine driving ranges identified by the engine speed and the basic fuel injection amount $T_p$. The equation (1) further includes $T_B$ which is a correction amount derived based on a battery voltage.

The FEEDBACK correction coefficient $K_{LAMBDA}$ is used to control the fuel injection amount $T_i$ for maintaining the air/fuel ratio of the air/fuel mixture at a target value, such as, a stoichiometric value in the FEEDBACK mode control which is performed in a predetermined stable engine driving condition. If it is possible to maintain the fuel injection amount $T_i$ at the stoichiometric value with the FEEDBACK correction coefficient being at a value of 1, then no FEEDBACK control is necessary in theory. However, in practice, due to tolerances in fuel injection valves, air-flow meters, pressure regulators and other engine components and further due to variations in functional characteristics of those components with the elapse of time which cause deviation or error between the arithmetically derived fuel injection amount and the practically injected fuel amount, the FEEDBACK control should be necessary for compensating such deviation or error.

However, during the air/fuel ratio being controlled in the OPEN LOOP mode, the above-noted deviation or error can not be compensated so that the air/fuel ratio of the air/fuel mixture is controlled with such deviation or error being included, resulting in the unreliable control of the fuel injection amount $T_i$. Further, after the air/fuel ratio control is shifted from the OPEN LOOP mode to the FEEDBACK mode, a considerable delay is caused before the air/fuel ratio reaches the stoichiometric value due to the PI control of the fuel injection amount $T_i$ on the basis of the FEEDBACK correction coefficient $K_{LAMBDA}$ which moderately modifies the fuel injection amount.

Accordingly, the system in this publication further uses the learnt correction coefficient $K_{LRC}$ which compensates the above-noted deviation or error bothe in the OPEN LOOP mode control and the FEEDBACK mode control. The learnt correction coefficient $K_{LRC}$ is stored for each of the mutually distinct various engine driving ranges and is updated on the basis of the instantaneous FEEDBACK correction coefficient $K_{LAMBDA}$ in a predetermined stable engine driving condition during the FEEDBACK mode control so as to adjust the FEEDBACK correction coefficient $K_{LAMBDA}$ toward a value of 1. Accordingly, even in the OPEN LOOP mode control, the above-noted deviation or error is effectively compensated to derive the reliable fuel injection amount $T_i$.

On the other hand, when a mixed fuel, such as, a gasoline/alcohol mixture fuel is used, a fuel injection amount $T_i$ may be derived on the basis of the following equation (2):

$$T_i = T_p \times C_{oef} \times K_{ALC} \times K_{LAMBDA} \times K_{LRC} + T_s \quad (2)$$

where, $K_{ALC}$ is an alcohol concentration dependent correction coefficient derived on the basis of an alcohol concentration indicative signal from an alcohol sensor which is disposed in a fuel supply line.

Since the stoichiometric value of the air/fuel ratio for the pure gasoline fuel is 14.7 while that for the fuel containing, such as, a methanol concentration of 100% is 6.5, the alcohol concentration dependent correction coefficient $K_{ALC}$ largely varies dependent on the alcohol concentration derived through the alcohol sensor. Accordingly, the learnt correction coefficient $K_{LRC}$ should also compensate the above-noted deviation or error which is variable dependent on the alcohol concentration in addition to the engine driving ranges specified by the engine speed and the basic fuel injection amount $T_p$. Further, the learnt correction coefficient should also compensate the above-noted deviation or error which is caused by tolerance in the alcohol sensor and the variation in functional characteristics of the alcohol sensor with the elapse of time.

However, since the learnt correction coefficient $K_{LRC}$ is set only with respect to each of the engine driving ranges identified by the engine speed and the basic fuel injection amount $T_p$ in the proposed air/fuel ratio control system, such as, disclosed in the above-noted Japanese Patent First Publication No. 59-203828, a considerable delay is caused before the air/fuel ratio reaches the stoichiometric value in the FEEDBACK mode control when the alcohol concentration contained in the fuel is largely varied. Further, the reliable fuel injection amount $T_i$ can not be derived in the OPEN LOOP mode control until the learning has been fully advanced for the fuel currently used.

SUMMARY OF THE INVENTION

Therefore, it is an object of the present invention to provide an air/fuel mixture ratio learning control system for an internal combustion engine using a mixed fuel that can eliminate the above-noted defect inherent in the background art.

It is another object of the present invention to provide an air/fuel mixture ratio learning control system for an internal combustion engine using a mixed fuel that can precisely control a fuel injection amount at a desired value both in a FEEDBACK mode air/fuel ratio control and in an OPEN LOOP mode air/fuel ratio control regardless of concentration of one fuel component contained in the mixed fuel.

To accomplish the above mentioned and other objects, according to one aspect of the present invention, an air/fuel mixture ratio learning control system for an internal combustion engine using a fuel which is adapted to contain first and second different fuel components, comprises:

air/fuel mixture induction means for receiving an intake air and the fuel to form an air/fuel mixture to be fed into an engine combustion chamber;

fuel supply means for supplying a controlled amount of the fuel into the induction means;

first sensor means, associated with the fuel supply means, for producing a first signal indicative of concentration of the first fuel component contained in the fuel to be fed into the induction means from the fuel supply means;

second sensor means for producing a second signal indicative of an air/fuel ratio of the air/fuel mixture;

third means for deriving a basic fuel amount based on a preselected basic engine operation parameter;

fourth means for deriving a first correction coefficient based on the first signal;

fifth means for deriving a FEEDBACK correction coefficient based on the second signal for adjusting the air/fuel ratio to be at a target value during a FEEDBACK mode control of the air/fuel ratio;

sixth means for deriving a second correction coefficient based on the FEEDBACK correction coefficient, the second correction coefficient being derived corresponding to one of predetermined engine driving ranges and one of predetermined concentration ranges of the first fuel component contained in the fuel, the one of the predetermined engine driving ranges being identified by an instantaneous value of the preselected basic engine operation parameter and the one of the predetermined concentration ranges being identified by an instantaneous value of the first signal, the second correction coefficient cyclically derived in a predetermined stable engine driving condition during the FEEDBACK mode control for updating one of the second correction coefficients previously derived and stored corresponding to the predetermined engine driving ranges and the predetermined concentration ranges of the first fuel component, the one of the second correction coefficients being stored for the same engine driving range and concentration range as those of the second correction coefficient which updates the one of the second correction coefficients;

seventh means for correcting the basic fuel amount based on the first and second correction coefficients and the FEEDBACK correction coefficient to control the fuel supply means to supply the fuel in an amount corresponding to the corrected fuel amount to the induction means.

BRIEF DESCRIPTION OF THE DRAWINGS

The present invention will be understood more fully from the detailed description given hereinbelow and from the accompanying drawings of the preferred embodiment of the invention, which are given by way of example only, and are not intended to be limitative of the present invention.

DESCRIPTION OF THE PREFERRED EMBODIMENT

Now, an air/fuel mixture ratio learning control system for an internal combustion engine according to a preferred embodiment of the present invention will be described hereinbelow with reference to FIGS. 1 to 4.

Figure 1:
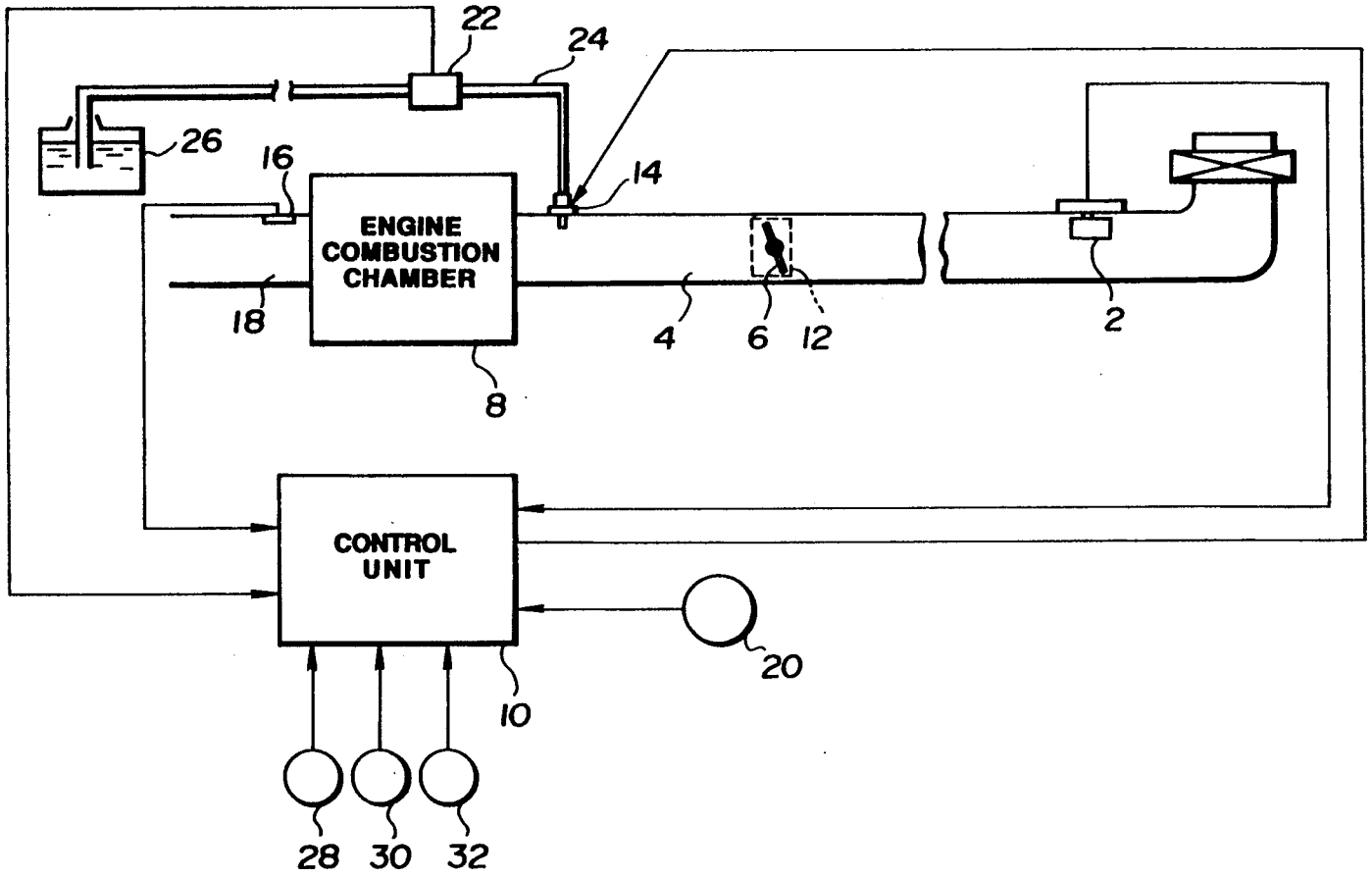
FIG. 1 is a schematic diagram showing an overall structure of an air/fuel mixture ratio learning control system for an internal combustion engine according to a preferred embodiment of the present invention.

FIG. 1 shows an overall structure of the air/fuel ratio learning control system according to the preferred embodiment of the present invention. In FIG. 1, an air-flow meter 2 working as an engine load sensor is provided in an air induction passage 4 upstream of a throttle valve 6 for producing a signal indicative of an intake air flow rate passing therethrough, which is to be conducted into respective engine combustion chambers 8 through the throttle valve 6. The intake air flow rate indicative signal from the air-flow meter 2 is fed to a control unit 10. The control unit 10 includes a microcomputer having CPU, RAM, ROM and an input/output circuit as known in the art. The throttle valve 6 is interconnected with an accelerator pedal (not shown) so as to adjust the intake air flow rate passing therethrough according to an accelerator pedal position. An opening angle of the throttle valve 6 is monitored by a throttle angle sensor 12 which produces a throttle opening angle indicative signal to be fed to the control unit 8. In an intake manifold arranged downstream of the throttle valve 6 is disposed an electro-magnetic fuel injection valve 14 per each engine combustion chamber 8.

The fuel injection valve 14 is controlled to be open in response to an injection pulse signal output from the control unit 10 to eject the pressurized gasoline-alcohol mixed fuel into the intake manifold so as to form an air/fuel mixture to be fed to the engine combustion chamber 8. An opening time of the injection valve 14 or a fuel injection time is determined by a pulse width of the injection pulse signal. The derivation of the injection pulse signal indicative of a fuel injection amount $T_i$ by the control unit 10 will be described in detail later.

An oxygen sensor 16 is provided in an exhaust passage 18 for monitoring oxygen concentration contained in an exhaust gas passing through the exhaust passage 18 to produce a signal indicative of the monitored oxygen concentration. In practice, the voltage of the oxygen concentration indicative signal varies across a zero voltage depending on the monitored air/fuel ratio being rich or lean relative to the stoichiometric value. A crank angle sensor 20 working as an engine speed sensor is provided in a distributer (not shown) for producing a crank unit angle signal and/or a crank reference angle signal. The control unit 10 calculates an engine revolutional speed by counting pulses of the crank unit angle signal or measuring a cycle period of the crank reference angle signal as in the know way.

An alcohol sensor 22 is arranged in a fuel passage 24 extending between a fuel tank 26 and the fuel injection valve 14 for producing a signal indicative of alcohol concentration contained in the fuel supplied from the fuel tank 26. The control unit 10 calculates the alcohol concentration based on electric capacitance across the alcohol sensor 22 as in the known way. The electric capacitance of the alcohol sensor 22 is variable depending on the alcohol concentration contained in the fuel.

The control unit 10 is further fed with various signals from other sensors, such as, a coolant temperature sensor 28 monitoring a temperature of an engine cooling water, a neutral switch 30 detecting a neutral position of a power transmission and a car speed sensor 32 monitoring an actual car speed.

The control unit 10 processes the foregoing signals to derive the fuel injection pulse signal indicative of the fuel injection amount $T_i$ based on the following equation (3):

$$T_i = T_p \times C_{oef} \times K_{ALC} \times K_{LAMBDA} \times K_{LRC} + T_s \quad (3)$$

In the equation (3), $T_p$ is a basic fuel injection amount derived by the control unit 10 on the basis of an engine speed monitored by the crank angle sensor 20 and an engine load (for example, an intake air flow rate monitored by the air-flow meter 2). $C_{oef}$ is a correction coefficient derived by the control unit 10 based on various engine operating parameters, such as an engine coolant temperature monitored by the coolant temperature sensor 28, and $K_{LAMBDA}$ is a FEEDBACK air/fuel ratio dependent correction coefficient derived based on an oxygen concentration indicative signal from the oxygen sensor 16 during the FEEDBACK mode control and composed of a proportional (P) component and an integral (I) component so as to perform the proportional-plus-integral control (PI control) of the fuel injection amount $T_i$ for adjusting the air/fuel ratio toward the stoichiometric value. The FEEDBACK correction coefficient $K_{LAMBDA}$ is kept at a predetermined fixed value, such as "1" during the OPEN LOOP mode control. $K_{LRC}$ is a learnt correction coefficient derived from the FEEDBACK correction coefficient $K_{LAMBDA}$ during a predetermined stable engine operating condition in the FEEDBACK mode control for each of predetermined engine driving ranges and for each of predetermined alcohol concentration ranges for minimizing a deviation of the FEEDBACK correction coefficient from a reference value, such as "1". The learnt correction coefficient $K_{LRC}$ is stored in RAM for each of the predetermined engine driving ranges and for each of the predetermined alcohol concentration ranges to be cyclically updated by a newly derived learnt correction coefficient $K_{LRC}$ in the same engine driving range and in the same alcohol concentration range during the above-noted predetermined stable engine operating condition. The equation (3) further includes $K_{ALC}$ which is an alcohol concentration dependent correction coefficient derived on the basis of an alcohol concentration indicative signal from the alcohol sensor 22, and $T_s$ which is a correction amount derived based on a battery voltage.

Figure 2:
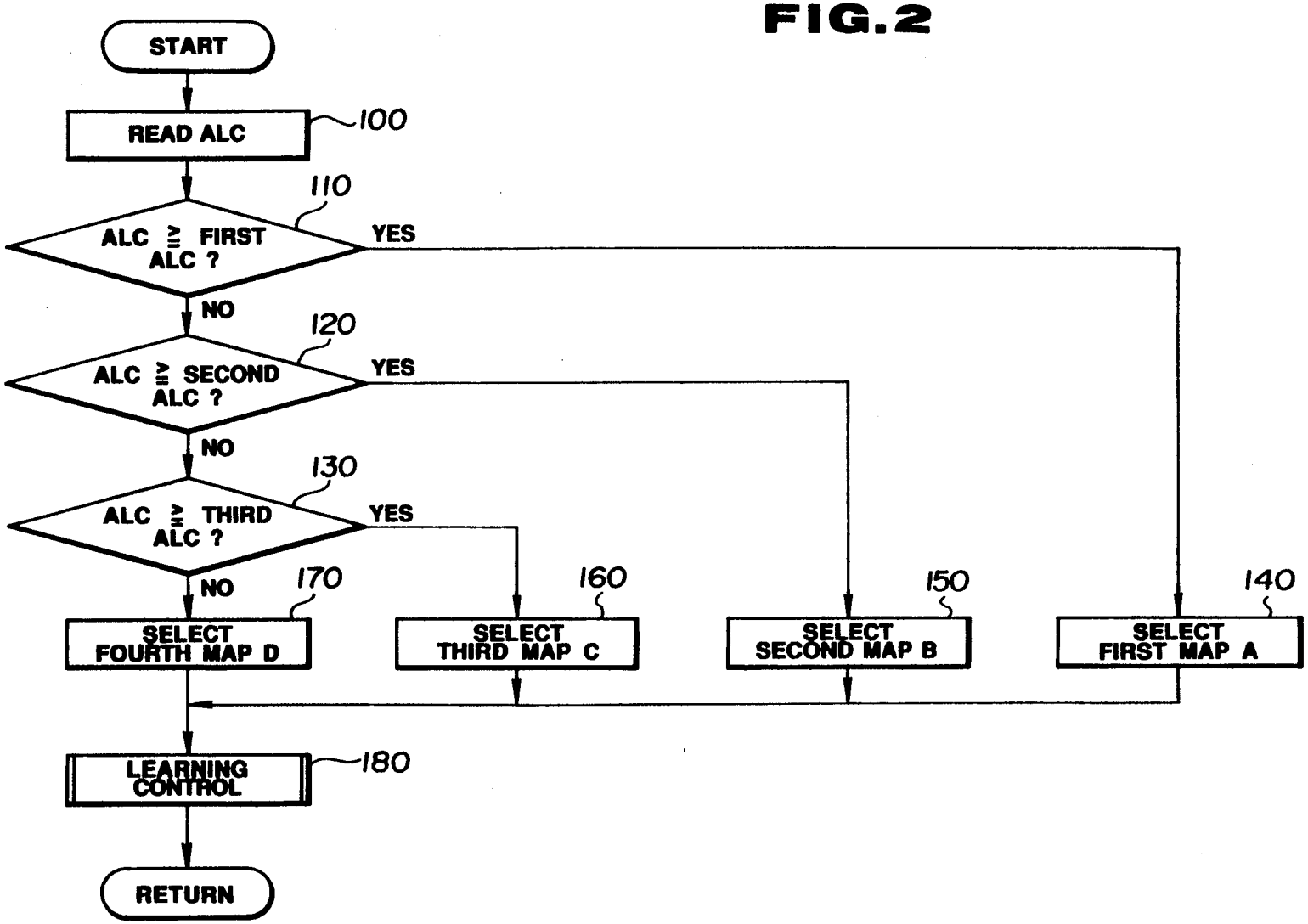
FIG. 2 is a flowchart of a fuel injection amount deriving main routine to be executed by a control unit in the preferred embodiment of FIG. 1.

FIG. 2 shows a flowchart of a fuel injection amount deriving routine to be executed by the control unit 10 for deriving a fuel injection amount $T_i$, i.e. a fuel injection pulse width $T_i$. The fuel injection amount deriving routine may be triggered at every given timing.

At a first step 100, an alcohol concentration (ALC) monitored by the alcohol sensor 22 is read out.

Figure 4:
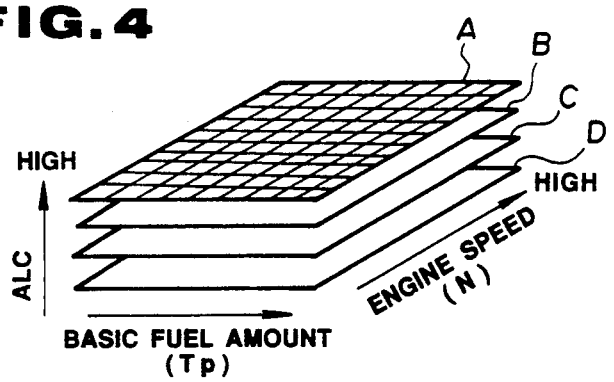
FIG. 4 is a schematic view showing learning maps for storing learnt correction coefficients.

Subsequently, one of first to fourth learning maps A to D is selected through steps 110 to 170. Specifically, as shown in FIG. 4, the first to fourth maps A to D are provided in RAM respectively corresponding to first to fourth predetermined alcohol concentrations. Each map includes a plurality of the learnt correction coefficients $K_{LRC}$ with respect to corresponding predetermined engine driving ranges each identified by an engine speed and a basic fuel injection amount $T_p$ or an engine load.

At the step 110, ALC derived at the step 100 is compared with the first predetermined alcohol concentration (FIRST ALC). If ALC is no less than FIRST ALC, i.e. a decision at the step 110 is YES, then the routine goes to the step 140, where the first learning map A is selected. On the other hand, if the decision at the step 110 is NO, then the routine goes to the step 120.

At the step 120, ALC is compared with the second predetermined alcohol concentration (SECOND ALC). If ALC is no less than SECOND ALC, then the routine goes to the step 150, where the second learning map B is selected. If the decision at the step 120 is NO, then the routine goes to the step 130.

At the step 130, ALC is compared with the third predetermined alcohol concentration (THIRD ALC). If ALC is no less than THIRD ALC, i.e. a decision at the step 130 is YES, then the routine goes to the step 160, where the third learning map is selected. On the other hand, if the decision at the step 130 is NO, then the routine goes to the step 170, where the fourth learning map is selected.

After one of the first to fourth learning maps A to D is selected at one of the steps 140 to 170, the routine goes to a step 170, where the fourth learning map is selected.

Figure 3:
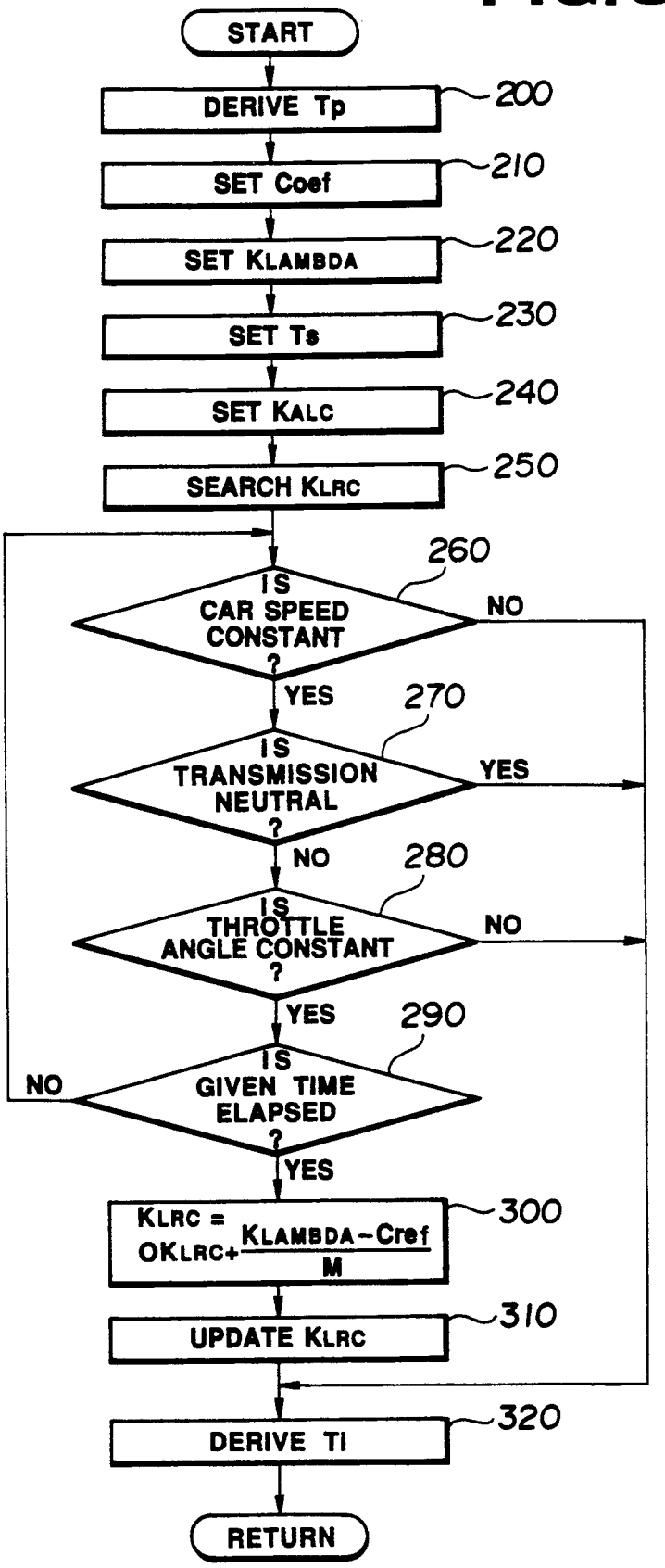
FIG. 3 is a flowchart of a subroutine for executing a learning control of the fuel injection amount to be executed by the control unit of FIG. 1.

After one of the first to fourth learning maps A to D is selected at one of the steps 140 to 170, the routine goes to a step 180, where a learning control subroutine as shown in FIG. 3 is executed.

At a first step 200 of the learning control subroutine, a basic fuel injection amount $T_p$ is derived based on an engine speed N monitored by the crank angle sensor 20 and an intake air flow rate Q monitored by the air-flow meter 2 using the following equation (4).

$$T_p = K \times Q/N \text{ (where, K is a constant)}$$

Subsequently, at a step 210, a correction coefficient $C_{oef}$ is set based on an engine coolant temperature monitored by the coolant temperature sensor 28 and other known engine operating parameters. Subsequently, at a step 220, a FEEDBACK air/fuel ratio dependent correction coefficient $K_{LAMBDA}$ is set based on an oxygen concentration indicative signal from the oxygen sensor 16 during the FEEDBACK mode control of the air/fuel ratio which is executed in a predetermined stable engine operating condition. Specifically, the FEEDBACK correction coefficient $K_{LAMBDA}$ is derived using the PI control on the basis of a deviation of the oxygen concentration indicative signal from a threshold value representative of the stoichiometric value. The FEEDBACK correction coefficient $K_{LAMBDA}$ is retained to a value of "1" in the OPEN LOOP mode control of the air/fuel ratio.

At a subsequent step 230, a battery voltage dependent correction amount $T_s$ is set based on a monitored voltage of the battery. Subsequently, at a step 240, an alcohol concentration dependent correction coefficient $K_{ALC}$ is set based on an alcohol concentration indicative signal from the alcohol sensor 22. In practice, the alcohol concentration dependent correction coefficient $K_{ALC}$ is set larger when the monitored alcohol concentration is larger. At a subsequent step 250, the learning map selected at one of the steps 140 to 170 is searched in terms of the engine speed N which was used to derive the basic fuel injection amount $T_p$ derived at the step 200, so as to read out a stored learnt correction coefficient $K_{LRC}$.

It is to be appreciated that the learnt correction coefficients $K_{LRC}$ are all initialized to 1 before the learning is started.

Subsequently, through steps 260 to 290, it is decided whether the engine is operating under a predetermined stable condition which satisfies a condition for deriving a new learnt correction coefficient $K_{LRC}$ and for updating a previously set or stored learnt correction coefficient $K_{LRC}$ with a new learnt correction coefficient $K_{LRC}$. Specifically, at the step 260, it is decided whether a car speed is constant based on an output signal from the car speed sensor 32 by comparing a variation in the car speed indicative signal with a given value. If the decision at the step 260 is NO, i.e. the car speed is not constant, then the routine goes to a step 320, which will be described later. On the other hand, if the decision at the step 260 is YES, then the routine goes to the step 270, where it is decided whether the power transmission is in a neutral position based on an output signal from the neutral switch 30. If the decision at the step 270 is YES, i.e. the transmission is in the neutral position, then the routine goes to the step 320, which will be described later. On the other hand, if the decision at the step 270 is NO, then the routine goes to the step 280, where it is decided whether a throttle angle is constant based on an output signal from the throttle angle sensor 12 by comparing a variation in the throttle angle indicative signal with a given value. If a decision at the step 280 is NO, i.e. the monitored throttle angle is not constant, when the routine goes to the step 320, which will be described later. On the other hand, if the decision at the step 280 is YES, then the routine goes to the step 290, where it is decided whether a predetermined time is elapsed commencing from a time point when the car speed is determined to be constant at the step 260. If a decision at the step 290 is NO, i.e. the predetermined time has not yet been elapsed, then the routine goes back to the step 260 to repeat the steps 260 to 290. If the decision at the step 290 is YES, then the routine goes to a subsequent step 300, where a new learnt correction coefficient $K_{LRC}$ is derived based on the stored learnt correction coefficient $K_{LRC}$ read out at the step 250 and the FEEDBACK correction coefficient $K_{LAMBDA}$ derived at the step 220 on the basis of the following equation (5):

$$K_{LRC}=OK_{LRC}+(K_{LAMBDA}-C_{ref})/M \quad (5)$$

where, $OK_{LRC}$ is the stored learnt correction coefficient derived at the step 250, $K_{LAMBDA}$ is the FEEDBACK correction coefficient derived at the step 220, $C_{ref}$ is a fixed reference value, such as, "1", and M is a constant larger than "1".

At a subsequent step 310, the stored $OK_{LRC}$ derived at the step 250 is updated by the new $K_{LRC}$ derived at the step 300. Accordingly, only when the predetermined stable engine condition is determined through the steps 260 to 290, $K_{LRC}$ is newly derived at the step 300 for updating $OK_{LRC}$ by the newly derived $K_{LRC}$.

It is to be appreciated that the steps 260 to 290 may be replaced by other proper steps for determining the predetermined stable engine driving condition. For example, those engine operating parameters, such as, a rich/lean inversion of the output signal from the oxygen sensor 16, variation in $K_{LAMBDA}$ and the like may be used for determining the above-noted predetermined stable engine driving condition.

Subsequently, at a step 320, a fuel injection amount $T_i$ is derived based on the foregoing equation (3). Specifically, when the new learnt correction coefficient $K_{LRC}$ is derived at the step 300 and the stored $OK_{LRC}$ is updated with the newly derived $K_{LRC}$, the newly derived $K_{LRC}$ is used as $K_{LRC}$ in the equation (3) for deriving the fuel injection amount $T_i$. On the other hand, when the steps 300 and 310 are not executed based on the decision at the steps 260 to 280 that the predetermined stable engine driving condition is not satisfied, the stored $OK_{LRC}$ is used as $K_{LRC}$ in the equation (3) to derive the fuel injection amount $T_i$. The control unit 10 outputs a fuel injection pulse signal with a pulse width corresponding to the derived fuel injection amount $T_i$ to the fuel injection valve 14. The fuel injection valve 14 supplies the fuel in an amount corresponding to a pulse width of the fuel injection pulse signal into the intake manifold to be introduced into the corresponding engine combustion chamber 14.

As appreciated from the above description, in the preferred embodiment of the present invention, since the learnt correction coefficient $K_{LRC}$ is set for each of the predetermined alcohol concentration ranges in addition to each of the predetermined engine driving ranges, an air/fuel ratio of the air/fuel mixture can be precisely controlled at a desired value without delay both in the FEEDBACK mode control and in the OPEN LOOP mode control of the air/fuel ratio even when an alcohol concentration contained in the fuel largely varies.

Figure 5:
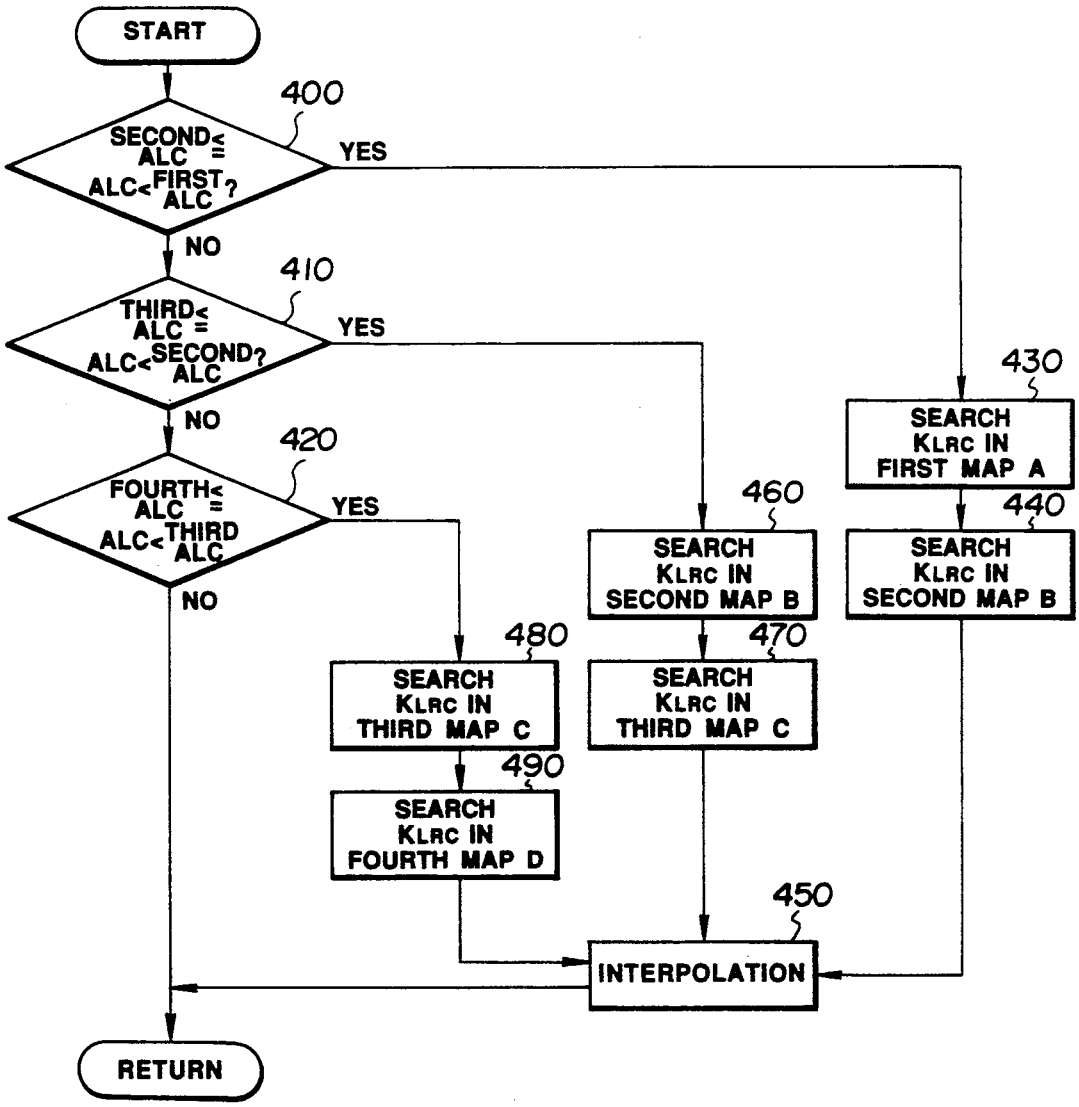
FIG. 5 is a flowchart of a subroutine for executing an interpolation of the learnt correction coefficients to be executed by the control unit of FIG. 1.

FIG. 5 shows a flow chart of an interpolation routine for interpolating the learnt correction coefficient $K_{LRC}$. The interpolation routine may be added between the steps 310 and 320, between the steps 260 and 320, between the steps 270 and 320 and between the steps 280 and 320 in the learning control subroutine of FIG. 3 as a subroutine so as to interpolate the stored $OK_{LRC}$ derived at the step 250 and the new $K_{LRC}$ derived and updated at the steps 300 and 310.

At a first step 400, it is decided whether ALC read out at the step 100 in FIG. 2 is less than FIRST ALC and no less than SECOND ALC. If a decision at the step 400 is YES, then the routine goes to a step 430, where $K_{LRC}$ in the first learning map A is searched in terms of the engine speed N and the basic fuel injection amount $T_p$ which were used at the step 250. Subsequently, at a step 440, $K_{LRC}$ in the second learning map B is searched in terms of the engine speed N and the basic fuel injection amount $T_p$ which are the same as those used at the step 430. Then, the routine goes to a step 450, where an interpolation calculation is performed in the following manner:

Assuming that FIRST ALC is 60% and $K_{LRC}$ read cut at the step 430 is 1.2 and that SECOND ALC is 30% and $K_{LRC}$ read out at the step 440 is 1.1, and further assuming that ALC derived at the step 100 is 40%, an interpolated $K_{LRC}$ is derived based on the following equation:

$$K_{LRC}=1.1+\{(40=30)/(60-30)\}\times(1.2-1.1)=1.1-$$
33

The interpolated $K_{LRC}$ derived above is used at the step 320 to derive the fuel injection amount $T_i$.

On the other hand, if the decision at the step 400 is NO, then the routine goes to a step 410, where it is decided whether ALC read out at the step 100 in FIG. 2 is less than SECOND ALC and no less than THIRD ALC. If a decision at the step 410 is YES, then the routine goes to a step 460, where $K_{KRC}$ in the second learning map B is searched based on the engine speed N and the basic fuel injection amount $T_p$ which were used at the step 250. Subsequently, at a step 470, $K_{LRC}$ in the third learning map C is searched in terms of the engine speed N and the basic fuel injection amount $T_p$ which are the same as those used at the step 460. Then, the routine goes to the step 450, where an interpolation calculation is performed in a manner as described above.

On the other hand, if the decision at the step 410 is NO, then the routine goes to a step 420, where it is decided whether ALC read out at the step 100 in FIG. 2 is less than THIRD ALC and no less than FOURTH ALC. if a decision at the step 420 is YES, then the routine goes to a step 480, where $K_{LRC}$ in the third learning map C is searched based on the engine speed N and the basic fuel injection amount $T_p$ which were used at the step 250. Subsequently, at a step 490, $K_{LRC}$ in the fourth learning map D is searched in terms of the engine speed N and the basic fuel injection amount $T_p$ which are the same as those used at the step 480. Then, the routine goes to the step 450, where an interpolation calculation is performed in a manner as described above.

On the other hand, if the decision at the step 420 is NO, then the routine goes to RETURN and no interpolation is performed. Accordingly, $K_{LRC}$ derived at the step 250 or $K_{LRC}$ derived and updated at the steps 300 and 310 is used at the step 320 without the interpolation for deriving the fuel injection amount $T_i$.

It is to be understood that this invention is not to be limited to the preferred embodiment described above, and that various changes and modifications may be made without departing from the spirit and scope of the invention as defined in the appended claims.

What is claimed is:

1. An air/fuel mixture ratio learning control system for an internal combustion engine using a fuel which contains a first fuel component and a second fuel component, said system comprising:

air/fuel mixture induction means for receiving intake air and said fuel to form an air/fuel mixture to be fed into an engine combustion chamber;

fuel supply means for supplying a controlled amount of said fuel into said induction means;

first sensor means, associated with said fuel supply means, for producing a first signal indicative of concentration of said first fuel component contained in said fuel to be fed into said air fuel mixture induction means from said fuel supply means;

second sensor means for producing a second signal indicative of an air/fuel ratio of said air/fuel mixture;

third means for deriving a basic fuel amount based on a preselected basic engine operation parameter;

fourth means for deriving a first correction coefficient based on said first signal;

fifth means for deriving a FEEDBACK correction coefficient based on said second signal for adjusting said air/fuel ratio to be at a target value during a FEEDBACK mode control of said air/fuel ratio;

sixth means for deriving a second correction coefficient based on said FEEDBACK correction coefficient, said second correction coefficient being derived corresponding to one of a plurality of predetermined engine driving ranges and one of a plurality of predetermined concentration ranges of said first fuel component contained in said fuel, one of said predetermined engine driving ranges being identified by an instantaneous value of said preselected basic engine operation parameter and one of said predetermined concentration ranges being identified by an instantaneous value of said first signal, said second correction coefficient cyclically derived in a predetermined stable engine driving condition during said FEEDBACK mode control for updating said second correction coefficient previously derived and previously stored corresponding to said predetermined engine driving ranges and said predetermined concentration ranges of said first fuel component, said second correction coefficient being stored after updating corresponding to one of said predetermined engine driving ranges and one of said predetermined concentrations ranges which was used to update said second correction coefficient; and seventh means for correcting said basic fuel amount to provide a corrected fuel amount based on said first correction coefficient and said second correction coefficient and said FEEDBACK correction coefficient to control said fuel supply means to supply said fuel to said induction means in an amount corresponding to said corrected fuel amount.

2. An air/fuel mixture ratio learning control system as claimed in claim 1, wherein said seventh means corrects said basic fuel amount based on said first correction coefficient and second correction coefficient during an OPEN LOOP mode control of said air/fuel ratio, and based on said first and second correction coefficients and said FEEDBACK correction coefficient during said FEEDBACK mode control of the air/fuel ratio.

3. An air/fuel mixture ratio learning control system as claimed in claim 1, wherein said second correction coefficient is derived for minimizing a deviation of said FEEDBACK correction coefficient from a reference value.

4. An air/fuel mixture ratio learning control system as set forth in claim 3, wherein said reference value is 1.

5. An air/fuel mixture ratio learning control system as claimed in claim 1, wherein said first and second fuel components are respectively alcohol and gasoline, and said first sensor means is an alcohol sensor.

6. An air/fuel mixture ratio learning control system as claimed in claim 2, wherein said seventh means uses said second correction coefficient updated in said predetermined stable engine driving condition for correcting said basic fuel amount, said seventh means using the previously derived and stored second correction coefficient in engine driving conditions other than said predetermined stable engine driving condition for correcting said basic fuel amount.

7. An air/fuel mixture ratio control system as claimed in claim 1, wherein said sixth means derives said second correction coefficient based on said FEEDBACK correction coefficient and the previously derived and previously stored second correction coefficient for the same predetermined engine driving range and predetermined concentration range as those specified by said instantaneous values.

8. An air/fuel mixture ratio control system as claimed in claim 5, wherein said first correction coefficient is set larger when the detected alcohol concentration is larger.

9. An air/fuel mixture ratio control system as claimed in claim 1, wherein said third means derives said basic fuel amount based on an engine speed indicative parameter and an engine load indicative parameter, and said predetermined engine driving ranges are specified by said engine speed indicative parameter and said basic fuel amount.

10. An air/fuel mixture ratio control system as claimed in claim 1, wherein said predetermined stable engine driving condition is determined based on a car speed indicative parameter, a transmission gear position indicative parameter and a throttle angle indicative parameter.

11. An air/fuel mixture ratio control system as claimed in claim 6, further comprising eighth means for interpolating said updated second correction coefficient or said previously derived and previously stored second correction coefficient, said interpolated second correction coefficient being used for correcting said basic fuel amount.

12. A control system for an internal combustion engine which has an air induction passage having a throttle valve therein and an exhaust passage, comprising:

a fuel tank storing a fuel containing a gasoline-alcohol mixed fuel;

means defining a fuel passage having one end communicating with said fuel tank and an opposite end communicating with said air induction passage at a portion down stream of said throttle valve;

an alcohol sensor means for detecting a concentration of alcohol contained in said fuel passing through said fuel passage and producing an alcohol concentration indicative signal indicative of said concentration of alcohol detected;

an oxygen sensor means for detecting a concentration of oxygen contained in exhaust gases passing through said exhaust passage and producing an oxygen concentration indicative signal indicative of said concentration of oxygen detected;

an engine speed sensor means for detecting an engine revolution speed of said engine and producing an engine speed indicative signal of said engine revolution speed detected;

an engine load sensor means for detecting a load on said engine and producing an engine load indicative signal indicative of said load on said engine detected;

a control unit operatively connected to said alcohol sensor means, said oxygen sensor means, said engine speed sensor means and said engine load sensor means, said control unit including:

means for determining a basic fuel amount in response to said engine speed indicative signal and said engine load indicative signal and producing a basic fuel amount indicative signal indicative of said basic fuel amount determined;

means for storing a plurality of learning maps, each including a plurality of correction coefficients for varying engine revolution speeds and basic fuel amounts;

means for comparing said alcohol concentration signal with a plurality of predetermined mutually exclusive ranges of concentrations of alcohol;

means for selecting one of said plurality of learning maps in response to a result from said means for comparing said alcohol concentration signal with said plurality of predetermined mutually exclusive ranges of concentrations of alcohol;

means for executing a predetermined learning control after having selected one of said learning maps and updating the corresponding one of said correction coefficients contained in one of said learning maps;

means for determining a correction coefficient for said engine speed indicative signal and said basic fuel amount indicative signal out of said plurality of learning maps and producing a correction coefficient indicative signal indicative of said correction coefficient determined;

means for calculating a fuel injection amount in response to said basic fuel injection amount indicative signal and said correction coefficient indicative signal and producing a fuel injection amount indicative signal indicative of said fuel injection amount calculated; and a fuel injection valve means for allowing injection of said fuel out of said fuel passage defining means into said engine in response to said fuel injection amount indicative signal.

13. A control system as claimed in claim 12, wherein said engine load sensor means includes an air flow sensor mounted to said air induction passage.

* * * * *